United States Patent [19]

Meisner et al.

[11] 4,321,697

[45] Mar. 23, 1982

[54] PROCESS AND CIRCUIT FOR THE SETTING OF AN ELECTRONIC DIGITAL DISPLAY

[75] Inventors: Alfred Meisner, Nuremberg; Hans Grasser, Eckental, both of Fed. Rep. of Germany

[73] Assignee: Diehl GmbH & Co., Nuremberg, Fed. Rep. of Germany

[21] Appl. No.: 60,397

[22] Filed: Jul. 25, 1979

[30] Foreign Application Priority Data

Aug. 11, 1978 [DE] Fed. Rep. of Germany ..... 2835200

[51] Int. Cl.[3] ..... G04C 9/00

[52] U.S. Cl. ..... 368/187; 368/188

[58] Field of Search ..... 58/23 R, 21.13, 21.155, 58/22.9, 39.5, 74, 85.5, 50 R; 368/82–84, 107–111, 185–187, 239

[56] References Cited

U.S. PATENT DOCUMENTS

| | | | |
|---|---|---|---|
| 3,733,803 | 5/1973 | Hiraga et al. | 58/23 R |
| 3,762,152 | 10/1973 | Marz | 58/23 R |
| 3,877,276 | 4/1975 | Mounce et al. | 58/39.5 |
| 3,978,296 | 8/1976 | Moriya et al. | 58/85.5 X |
| 3,988,886 | 11/1976 | Kashio | 58/23 R |
| 4,107,915 | 8/1978 | Sekiya et al. | 58/23 R |
| 4,143,509 | 3/1979 | Weibel | 58/85.5 X |
| 4,176,516 | 12/1979 | Kodama | 58/23 R |

*Primary Examiner*—Vit W. Miska

*Attorney, Agent, or Firm*—Scully, Scott, Murphy & Presser

[57] ABSTRACT

A process and circuit for the setting of an electronic digital display for a desired time period, particularly the cooking time of a microwave oven. The setting is effected through a series of stepping pulses controlling the registers of counter-display units for a time period which is subdivided into predetermined time units.

5 Claims, 1 Drawing Figure

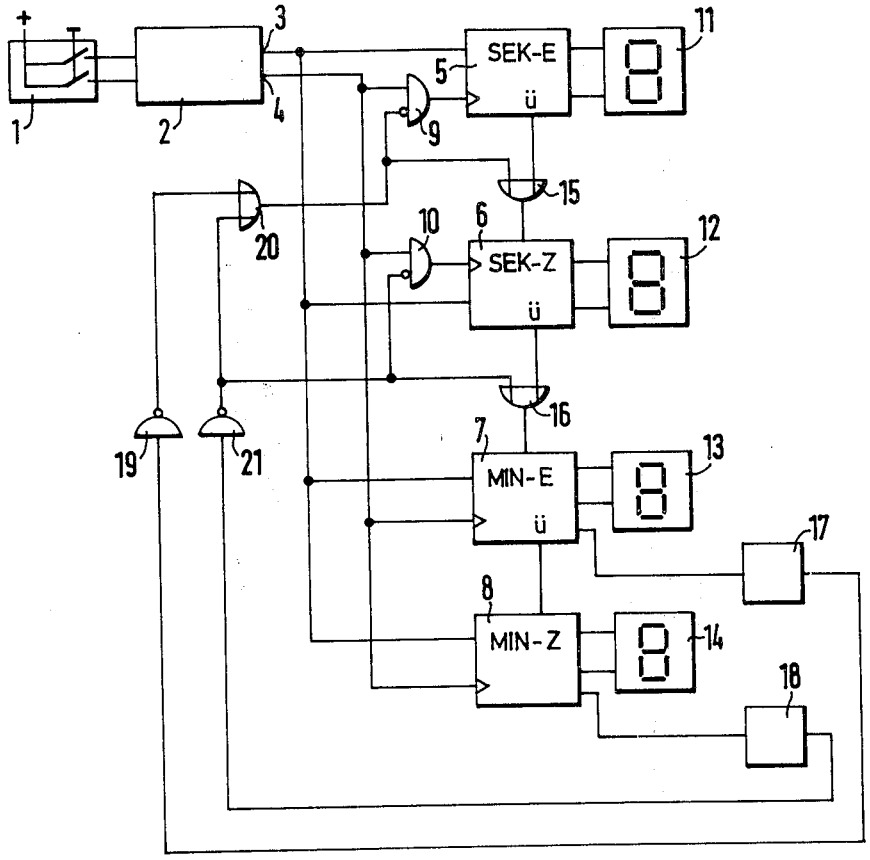
+
1
2
3
4
5
SEK-E
ü
9
11
15
10
6
SEK-Z
ü
12
20
16
19
21
7
MIN-E
ü
13
17
8
MIN-Z
14
18

PROCESS AND CIRCUIT FOR THE SETTING OF AN ELECTRONIC DIGITAL DISPLAY

BACKGROUND OF THE INVENTION

1. Field of the Invention

The present invention relates to a process for the setting of an electronic digital display for a desired time period, in particular the cooking time of a microwave oven, in which the setting is undertaken through a series of stepping pulses. Furthermore, the invention relates to a circuit for the implementation of the process.

2. Discussion of the Prior Art

German Patent Application No. P26 28 794.5 describes an electro-mechanical setting arrangement for an electronic digital display. Through the intermediary of an impulse generator which must be manually actuated, there are generated stepping pulses for the setting of the electronic digital display. Herein, the input speed is quite restricted. Accordingly, for this purpose there has been proposed in German Patent Application No. P27 26 383 to superproportionately increase the frequency of the stepping pulses from a predetermined input frequency. This display can thus be rapidly adjusted over a number of hours.

In German Patent Application P28 28 285.1 there is proposed a process for the generation and processing of stepping pulses for the setting and, respectively, correcting of an electronic digital display. Hereby, a microprocessor is connected intermediate the electromechanical impulse generator and the display. This arrangement results in an increase in the potential input speed.

When it should become possible to set hours and minutes, then the microprocessor for effecting the setting has to process $24 \times 60 = 1440$ setting possibilities.

In arrangements which there is to be set a desired time period for an operating sequence, for example such as ovens, particularly microwave ovens, it is not of particular significance that within the entire possible time range the desired time period is accurately set to the last place. Thus, for example, in microwave ovens at short desired time periods it is necessary to provide a setting capability which is accurate to within seconds. For lengthier desired time periods it is sufficient to have a setting which is accurate to within minutes.

SUMMARY OF THE INVENTION

Accordingly, it is an object of the present invention to propose a process of the above-mentioned type through which there can be set desired time periods with a sufficient degree of accuracy by means of a small number of stepping pulses.

The foregoing object is inventively achieved that the span of the maximum settable desired time period is subdivided into a number of time periods and wherein through the stepping pulses within a first time period there are reset the units register and the tens register of a first time unit, and within a second time period the tens register of the first time unit and the units register of a second time unit superior and next more significant in time than on the first time unit, and within a third time period the units register and the tens register of the superior, next significant second time unit and, if desired, within further time periods the corresponding units and tens registers of further superior time units. Hereby, within each time period it is possible to achieve a setting which is accurate to two places. A third or further register is not reset through stepping pulses.

When the first time unit represents seconds and the superior second time unit the minutes, then the first time period lies between 1 second and 59 seconds, the second time period between 1 minute 10 seconds and 9 minutes 50 seconds, and the third time period between 10 minutes and 99 minutes. It has been indicated that there must be hereby processed a total of only 204 possible settings. In contrast therewith, when the units register and the tens register of the first time unit would have to be reset continuously also within the second and third time periods, there would have to be processed 6000 setting possibilities. The invention has the attendant advantage that for effecting the setting, in contrast with the state of the art, only a few stepping pulses are necessary so that, on the one hand, the setting can be rapidly undertaken and, on the other hand, the processing capacity of a circuit which produces the stepping pulses from an electro-mechanical impulse generator can be held small.

In a further embodiment of the invention, when the units register of the superior second time unit is not equal to zero and the tens register of this unit is equal to zero, through the stepping pulses the tens register of the first time unit is switched forwardly and thereafter, when the tens register of the superior second time unit is not equal to zero, the units register of this second time unit is switched forward by the stepping pulses.

In a preferred modification of the invention, in the instances wherein the setting of the display is controlled by timing or synchronizing impulses, when the units register of the superior second time unit is not equal to zero, then the synchronizing impulses for the units register of the first time unit are blocked and, when the tens register of the superior second time unit is not equal to zero, then the synchronizing impulses for the units register and the tens register of the first time unit are blocked. This avoids the possibility that within the second time period the units register of the first time unit and in the third time period the units register and tens register of the first time unit will be reset concurrently with higher registers in a manner which would be confusing to a user.

A circuit for the implementation of the above-described process including a counter-display unit for respectively each register, wherein there is presently conducted the transmission signal of the counter of a display unit to the counter of the next higher display unit, is characterized by the fact that the stepping pulses are present at all counter-display units and that, when the counter of a superior display unit is at a value which is not equal to zero, an enabling signal tapped off therefrom is conducted in lieu of the transmission signal to the counter of the display unit which is inferior, less significant to this display unit.

BRIEF DESCRIPTION OF THE DRAWING

Further advantageous embodiments of the invention can now be ascertained from the following detailed description and the single FIGURE of the accompanying drawing illustrating a schematic block diagram of a setting display for a microwave oven.

DETAILED DESCRIPTION

A manually actuatable electro-mechanical impulse generator 1 generates series of pulses which are evaluated in an impulse evaluating circuit 2 which, for example, can be embodied in a micro-processor 2. Such impulse evaluating circuits are known, for instance, from the above-mentioned prior art publications.

At an output 3 of the impulse evaluating circuit 2 is presented a stepping pulse series conforming to the current displacement of the impulse generator 1. A synchronizing or timing signal appears at an output 4 of this impulse evaluating circuit.

The output 3 is connected with the count inputs of four forward-backward counters 5, 6, 7 and 8. The output 4 is connected to the synchronizing input of the counter 5 through an AND gate 9, to the synchronizing input of the counter 6 through an AND gate 10, and is directly connected to the synchronizing inputs of the counters 7 and 8.

Each of the counters has associated therewith a single-place digital display unit 11, 12, 13 and 14.

The display unit 11 serves for the display of the single seconds 0 through 9, the display unit 12 for the ten-seconds 0 through 5, the display unit 13 for the single minute 0 through 9, and the display unit 14 for the ten-minute 0 through 9. A carry output of the counter 5 is connected to the enabling input of the counter 6 through an OR gate 15. The carry output of the latter is connected with enable input of the counter 7 through an OR gate 16. The carry output of the counter 7 is directly connected to a enable input of the counter 8.

The counting position of the counters 7 and 8 is monitored through respectively zero discriminators 17 and 18. The output of the discriminator 17 is connected to the OR gate 15 through an inverter 19 and an OR gate 20, and to a negating input of the AND gate. The output of the discriminator 18 is connected, on one side, through an inverter 21 with the OR gate 20 and, on the other side, with the OR gate 16 and a negating input of the AND gate 10.

Upon the actuating of the impulse generator 1 there appears at the output 3 stepping pulses corresponding in their number to the actuation. The timing pulse at the output 4 is independent thereof. Assuming that all counters are set at zero, then at the beginning of the actuation of the impulse generator, initially the counter 5 switches ahead one step for each stepping pulse. The remaining counters 6, 7 and 8 are initially still blocked at their enabling inputs. In contrast therewith, the display units 12, 13 and 14 are still set to zero and display unit 11 is switched through from 0 to 9. When the counter 5, in essence the display unit 11 stands at 9, then the counter 6 is enabled through the carry output. At the next stepping pulse the counter 5 is set to 0 and counter 6 to 1. Further stepping pulses will again switch up to the transfer of the counter 5. These sequences repeat themselves until the counter 6 is set at 5. Within this first time period there is thus effected a setting stepped in seconds:

| Min. | Sec. |
|---|---|
| 00 | 01 |
| 00 | 02 |
| . | . |
| . | . |
| . | . |
| 00 | 59 |

At the subsequent stepping pulse the counters 5 and 6 are set to 0 and the counter 7 to 1. Through the discriminator 17 and the inverter 19, as well as the OR gate 20, there is blocked the AND gate 9 so that the synchronizing or timing input of the counter 5 is clocked and another stepping pulse can set this further. Concurrently, the output signal of the discriminator 19 is present at the OR gate 15 so that the enable input of the counter 6, independently of the carry output of the counter 5, allows for the further setting of the counter 6. At subsequent stepping pulses, the counter 6 is thus directly further switched. The carry output thereof correspondingly switches forward the counter 7. Within this second time period there is effected the following setting:

| Min. | Sec. |
|---|---|
| 01 | 00 |
| 01 | 10 |
| 01 | 20 |
| . | . |
| . | . |
| . | . |
| 09 | 50 |

At the stepping pulse following the setting to 9 minutes: 50 seconds, the counters 6 and 7 are set to 0 and the counter 8 to 1. This will cause the discriminator 18 to respond and to block through the inverter 21 and the AND gate the synchronizing input of the counter 6. Through the OR gate 20 and the AND gate 9, the synchronizing input of the counter 5 continues to remain blocked. Moreover, the output signal of the discriminator 18 switches free counter 7 at its release input through the inverter 21 and the OR gate 16. Further stepping pulses act now directly on the counter 7 whereby presently, at a carry signal at the counter 7, the counter 8 is switched forward by a further place. Within this third time period there is effected the following setting:

| Min. | Sec. |
|---|---|
| 10 | 00 |
| 11 | 00 |
| 12 | 00 |
| . | . |
| . | . |
| . | . |
| 98 | 00 |
| 99 | 00 |

In total there is hereby possible to effect the setting of the counter, in essence to display units, within the three time periods with 204 stepping pulses. The counters, in effect the display units, can be set forwards as well as backwards. Obtained thereby is an adjustability within a large time period with only a few impulses which is accurate to the places. In conformance with the present setting of the desired time period effected by means of the impulse generator 1, through the impulse circuit 2 there can be controlled the cooking time of a microwave oven (not shown in detail herein). Commencing from the selected setting, at the beginning of the cooking time the impulse evaluating circuit 2, without switching of the periods, counts the counter 5, 6, 7 and 8 backwards in a second beat whereby the running of the cooking time can be followed on the display units 11, 12, 13 and 14. When all counters have counted back to zero, the microwave oven will then switch off.

The described process can also be utilized with other time periods, for example, within minute and hour periods or over a larger time period for example, in a second, minute and hour period.

What is claimed is:

1. In a process for the setting of the electronic digital display of a desired time period, particularly the cooking time of a microwave oven, wherein the setting is effected through a series of stepping pulses, the improvement comprising: subdividing the span of the maximum settable desired time period into a plurality of time periods, and switching forwardly through said stepping pulses the units register and the tens register of a first time unit within a first time period, with a second time period the tens register of said first time unit and the units register of a second time unit superior in time to said first time unit, and within a third time period the units register and the tens register of the superior second time unit, and controlling the setting of the display through synchronizing pulses, blocking the synchronizing pulses for the units register of the first time unit when the units register of the superior second time unit is not equal to zero, and blocking the synchronizing pulses of the units register and the tens register of the first time unit when the two registers of the superior second time unit are not equal to zero.

2. Process as claimed in claim 1, wherein the tens register of said first time unit is switched forwardly through said stepping pulses when the units register of the superior second time unit is not equal to zero and the tens register of said second time unit is equal to zero and, when the tens register of the superior second time unit is not equal to zero, switching forwardly the units register of said second time unit through said stepping pulses.

3. In a circuit for the setting of the electronic digital display of a desired time period, particularly the cooking time of a microwave oven, wherein the setting is effected through a series of stepping pulses, including a counter-display means for each display register, wherein a carry signal of respectively the counter of one display means is transmitted to the counter of the next superior display means, the improvement comprising: said stepping pulses being present at all counter-display means whereby when the counter of a superior display means is at a value not equal to zero, an enabling signal obtained therefrom is transmitted to the counter of a display means inferior to said first-mentioned display means in lieu of the carry signal.

4. Circuit as claimed in claim 3, said enabling signal blocking the synchronizing inputs of said display means which are inferior to the display means at which there is present the enabling signal in lieu of the carry signal.

5. Circuit as claimed in claim 3 or 4, said display means including single-second, ten-second, single-minute and ten-minute display means, comprising AND gates at the synchronizing inputs of the counters for said single-seconds and the ten-seconds, said AND gate associated with the counter of the single-seconds being blockable by a discriminator connected to the output of the counter of the single-minutes or through an OR gate of a discriminator associated with the output of the counter of the ten-minutes, an OR gate being connected to the carry outputs of each of the single-second and ten-second counters whereby the output of the discriminator associated with the single-minute counter is connected to the OR gate connected to the output of the single-second counter, and the output of the discriminator associated with the ten-minute counter is connected to the other OR gate.

* * * * *